US012221317B2

(12) United States Patent
Hamada

(10) Patent No.: US 12,221,317 B2
(45) Date of Patent: Feb. 11, 2025

(54) FEEDING DEVICE THAT CALCULATES RIGIDITY OF SHEET ACCORDING TO CURVATURE INFORMATION OUTPUTTED BY SHEET SENSOR

(71) Applicant: KYOCERA Document Solutions Inc., Osaka (JP)

(72) Inventor: Takuya Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 255 days.

(21) Appl. No.: 17/967,954

(22) Filed: Oct. 18, 2022

(65) Prior Publication Data

US 2023/0130089 A1 Apr. 27, 2023

(30) Foreign Application Priority Data

Oct. 22, 2021 (JP) ..... 2021-173001

(51) Int. Cl.
*B65H 7/14* (2006.01)

(52) U.S. Cl.
CPC ..... *B65H 7/14* (2013.01); *B65H 2511/17* (2013.01); *B65H 2515/81* (2013.01); *B65H 2553/30* (2013.01); *B65H 2553/414* (2013.01); *B65H 2801/06* (2013.01)

(58) Field of Classification Search
CPC .. B65H 7/14; B65H 2511/17; B65H 2515/81; B65H 2553/30; B65H 2553/414; B65H 2801/06
See application file for complete search history.

(56) References Cited

U.S. PATENT DOCUMENTS

2005/0286916 A1* 12/2005 Nakazato ..... G03G 15/6573 399/16
2018/0273319 A1* 9/2018 Hasegawa ..... B65H 9/002
2022/0009734 A1* 1/2022 Numata ..... B65H 3/0669

FOREIGN PATENT DOCUMENTS

DE 60025672 * 7/2006
GB 2055226 * 2/1981
JP H09251250 A 9/1997

* cited by examiner

*Primary Examiner* — Thomas A Morrison

(74) *Attorney, Agent, or Firm* — IP Business Solutions, LLC.

(57) ABSTRACT

A feeding device includes a sheet tray, a transport device, a sheet sensor, and a control device. On the sheet tray, a sheet is placed. The transport device transports the sheet placed on the sheet tray. The sheet sensor is located upstream of the transport device in a sheet transport direction, and outputs curvature information indicating a curvature status of the sheet being transported by the transport device. The control device includes a processor, and acts as a measuring device and a calculation device, when the processor executes a control program. The measuring device measures a curvature amount of the sheet, on a basis of the curvature information. The calculation device calculates rigidity of the sheet, on a basis of the curvature amount.

4 Claims, 11 Drawing Sheets

FEEDING DEVICE THAT CALCULATES RIGIDITY OF SHEET ACCORDING TO CURVATURE INFORMATION OUTPUTTED BY SHEET SENSOR

INCORPORATION BY REFERENCE

This application claims priority to Japanese Patent Application No. 2021-173001 filed on Oct. 22, 2021, the entire contents of which are incorporated by reference herein.

BACKGROUND

The present disclosure relates to a feeding device.

Some of existing image forming apparatuses are configured to measure a slack of a recording sheet, produced when the leading edge of the recording sheet is abutted against a stopper plate, to thereby evaluate the stiffness of the recording sheet.

SUMMARY

The disclosure proposes further improvement of the foregoing techniques.

In an aspect, the disclosure provides a feeding device including a sheet tray, a transport device, a sheet sensor, and a control device. On the sheet tray, a sheet is placed. The transport device transports the sheet placed on the sheet tray. The sheet sensor is located upstream of the transport device in a sheet transport direction, and outputs curvature information indicating a curvature status of the sheet being transported by the transport device. The control device includes a processor, and acts as a measuring device and a calculation device, when the processor executes a control program. The measuring device measures a curvature amount of the sheet, on a basis of the curvature information. The calculation device calculates rigidity of the sheet, on a basis of the curvature amount.

DETAILED DESCRIPTION

Figure 1:
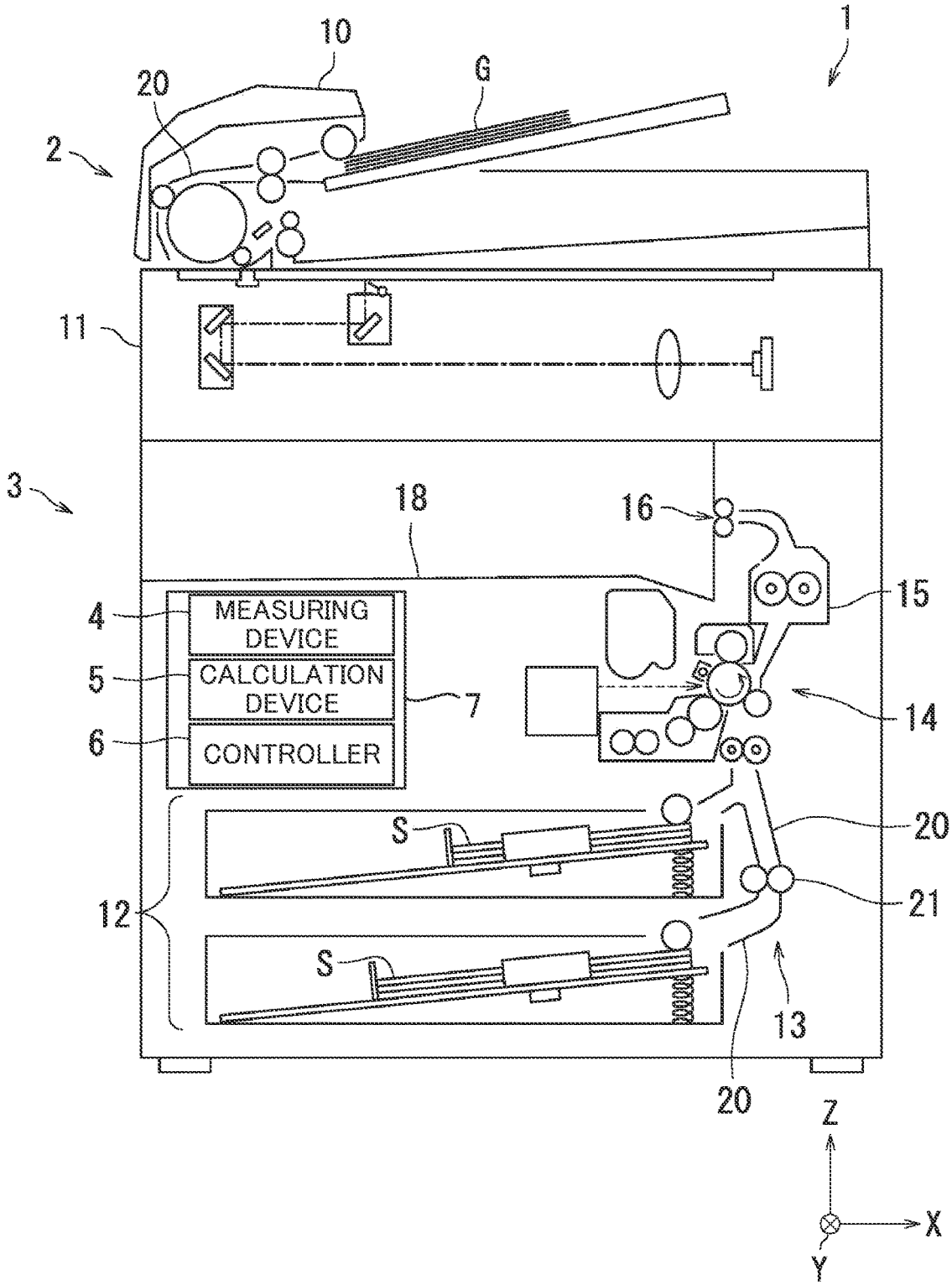
FIG. 1 is a cross-sectional view showing a structure of a multifunction peripheral including a feeding device according to an embodiment of the disclosure.

Hereafter, an embodiment of the disclosure will be described, with reference to the drawings. In the drawings, the same or corresponding elements are given the same numeral, and the description of such elements will not be repeated. FIG. 1 indicates an X-axis, a Y-axis, and a Z-axis which are orthogonal to each other. The Z-axis is parallel to a vertical plane. The X-axis and the Y-axis are parallel to a horizontal plane.

In this embodiment, the Z-axis direction, corresponding to the transport direction of a sheet S in an image forming device 14, may be referred to as a sub scanning direction, where appropriate. The Y-axis direction may be referred to as a main scanning direction. The X-axis direction may be referred to as the direction intersecting both of the main scanning direction and the sub scanning direction.

Figure 2A:
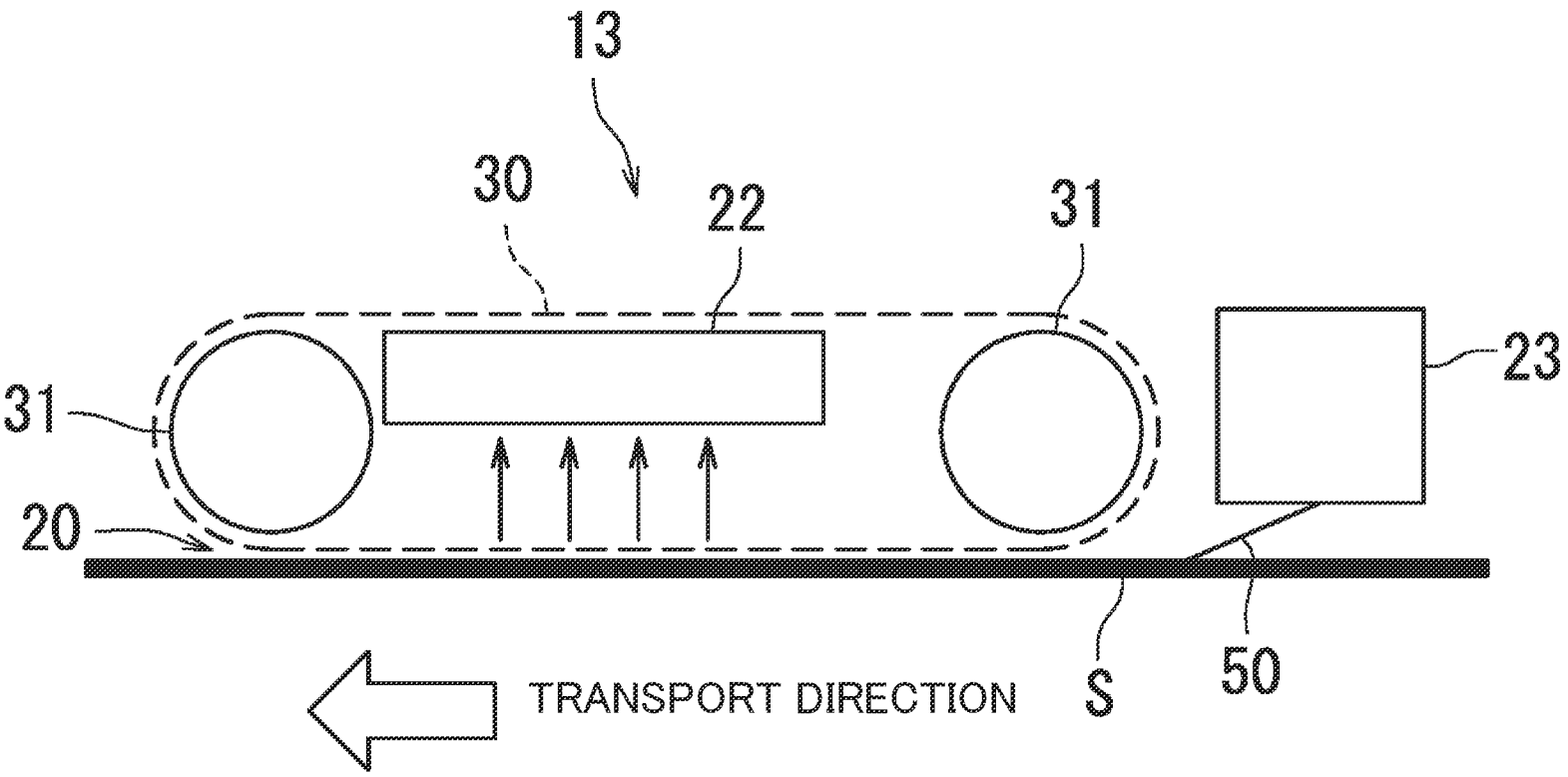
FIG. 2A and FIG. 2B are schematic drawings each showing the feeding device according to the embodiment.
Figure 2B:
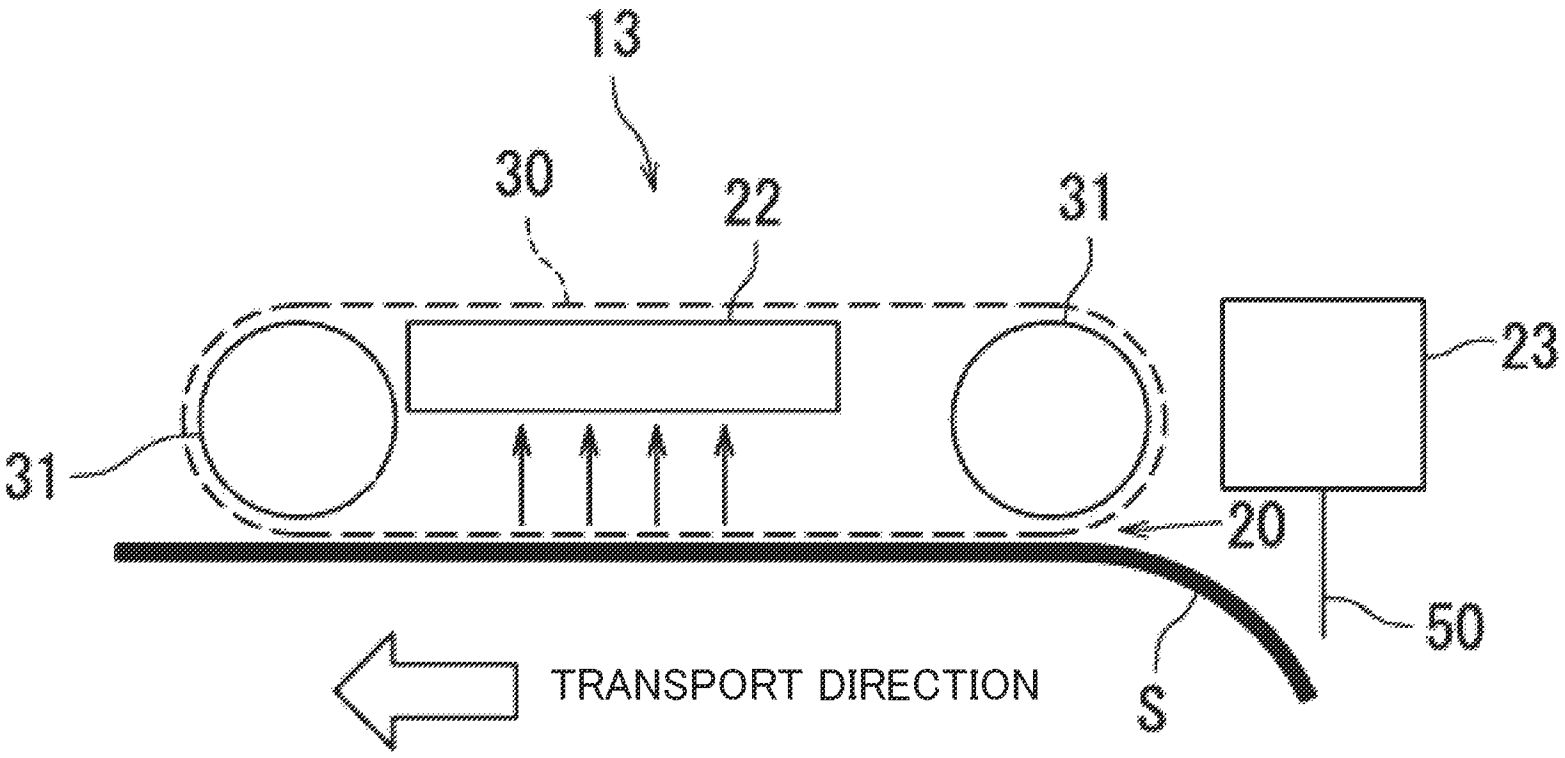
Figure 3:
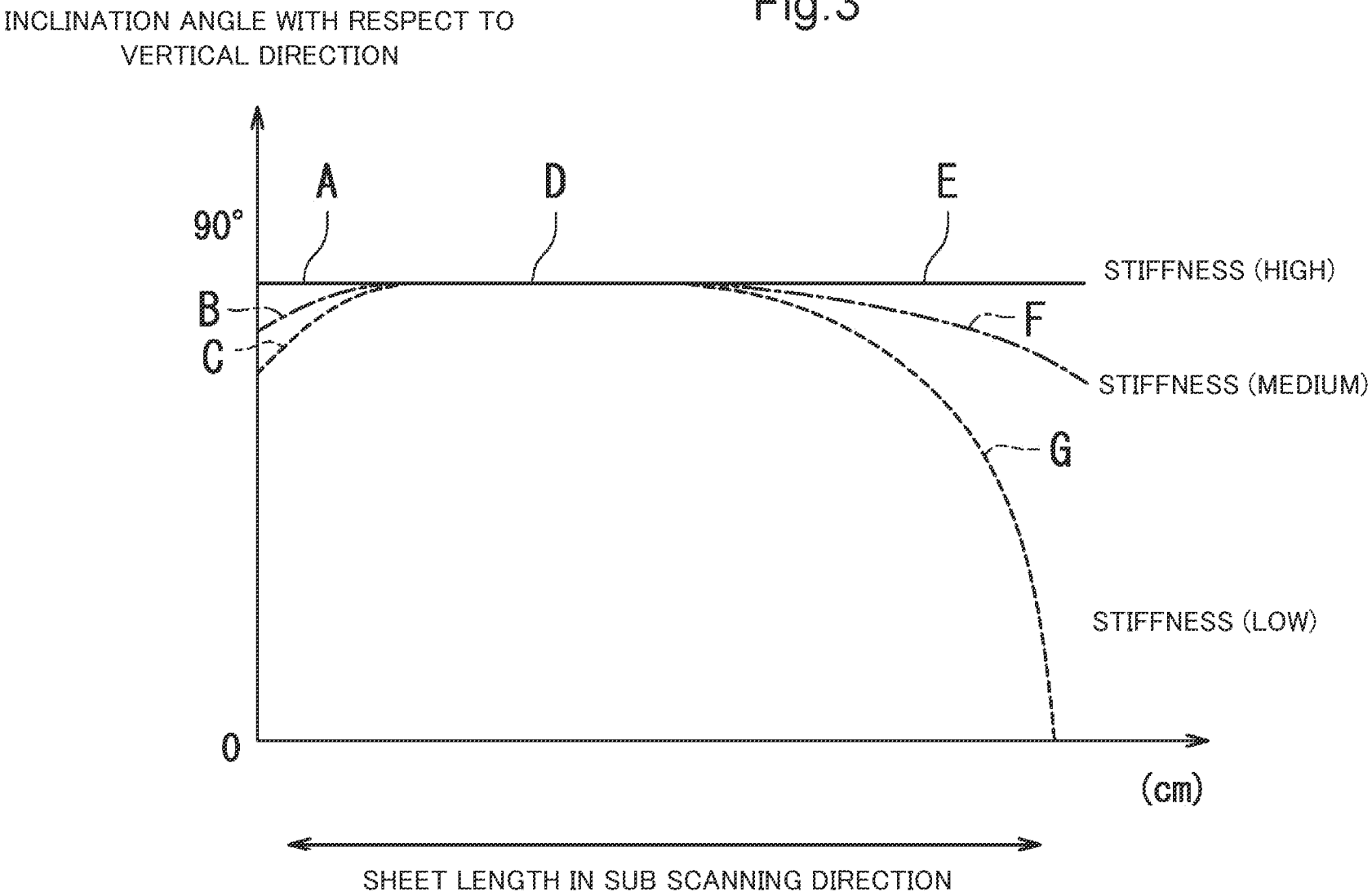
FIG. 3 is a graph for explaining curvature information outputted by a sheet sensor according to the embodiment.
Figure 4:
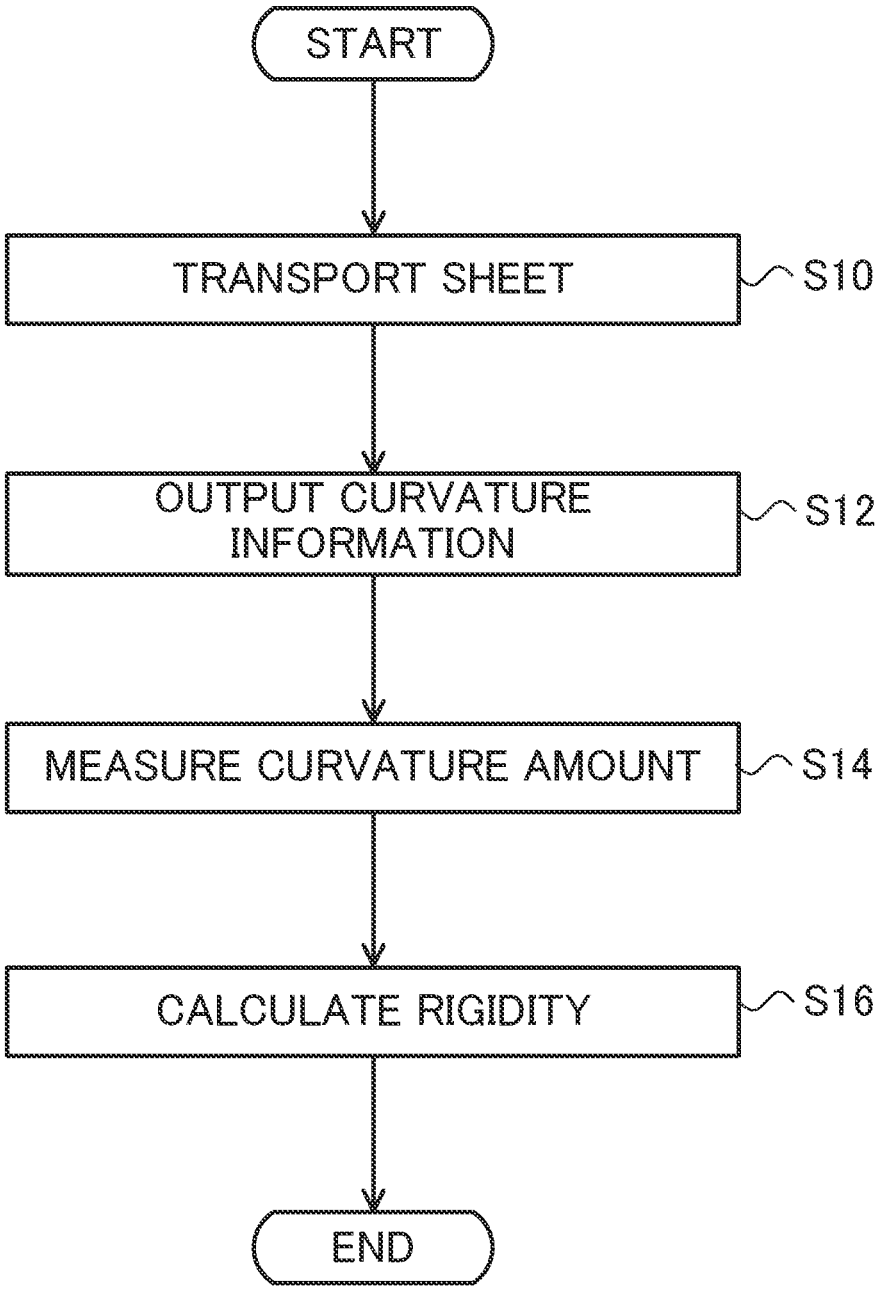
FIG. 4 is a flowchart showing a rigidity calculation process.

Referring to FIG. 1 to FIG. 4, a multifunction peripheral (MFP) 1 including a feeding device 13 according to the embodiment of the disclosure will be described hereunder. FIG. 1 is a cross-sectional view showing a structure of the MFP 1. FIG. 2A and FIG. 2B are schematic drawings each showing the feeding device 13 according to the embodiment. FIG. 3 is a graph for explaining curvature information outputted by a sheet sensor 23 according to the embodiment. FIG. 4 is a flowchart showing a rigidity calculation process according to the embodiment.

Referring to FIG. 1, the MFP 1 has the functions of scanning, copying, printing, facsimile transmission, and so forth. The MFP 1 may be, for example, a copier or a facsimile machine, or a multifunction peripheral having both of such functions.

As shown in FIG. 1, the MFP 1 includes a document reading device 2, an image forming apparatus 3, and a control device 7. The control device 7 includes a processor. The control device 7 acts as a measuring device 4, a calculation device 5, and a controller 6, when the processor executes a control program stored in a read-only memory (ROM) or a hard disk drive (HDD).

The document reading device 2 includes a document transport device 10, and an image reading device 11. The document transport device 10 includes, for example, a document tray, a document feeding device, a document sensor, and a document discharge device. The document transport device 10 can be exemplified by an automatic document feeder (ADF).

The image reading device 11 includes an optical system. The optical system includes, for example, a light emitter, a lens, a reflecting mirror, and a photodetector. The image reading device 11 reads the image of a source document G transported by the document transport device 10. The image reading device 11 generates image data representing the image that has been read. The image reading device 11 can be exemplified by a scanner incorporated with a contact image sensor (CIS) or a charge-coupled device (CCD).

In this embodiment, the image forming apparatus 3 is a printer that employs an electrophotography process. The image forming apparatus 3 includes a sheet tray 12, a feeding device 13, the image forming device 14, a fixing device 15, and a sheet delivery device 16. In particular, when the feeding device 13 includes a horizontal portion, the feeding device 13 according to this embodiment can be advantageously applied to the image forming apparatus 3 that employs the electrophotography process.

The sheet tray 12 is for placing the sheet S thereon. A transport device 21 of the feeding device 13 transports the sheet S placed on the sheet tray 12. The image forming device 14 includes, for example, an image data input device, a charging device, an exposure device, a developing device, a transfer device, and a cleaning device. The image forming device 14 forms a toner image on the sheet S, on the basis of the image data.

Here, the image forming apparatus 3 may be an ink jet printer instead. When the image forming apparatus 3 is the ink jet printer, the image forming device 14 at least includes an ink tank, an ink cartridge, and an ink head. The image forming device 14 forms an ink image on the sheet S, on the basis of the image data. When the image forming apparatus 3 is the ink jet printer, image forming apparatus 3 may be without the fixing device 15.

The fixing device 15 heats and presses the toner image formed on the sheet S, thereby fixing the toner image onto the sheet S. The fixing device 15 includes, for example, a fixing belt, a pressure roller, and a heater.

The fixing belt has a hollow cylindrical shape. The pressure roller is pressed against the fixing belt, so as to define a nip region in collaboration therewith. The pressure roller causes the fixing belt to rotate upon being driven by a drive device.

The heater heats up the fixing belt, with power supplied from a power source. The heater is located in the vicinity of the inner circumferential surface of the fixing belt. The sheet S, transported by a sheet transport device to be subsequently described, is heated by the heater when passing through the nip region, so that the toner image is fixed onto the sheet S.

The sheet delivery device 16 delivers the sheet S to outside of the casing of the MFP 1. The sheet delivery device 16 includes a delivery roller and an output tray 18. The delivery roller delivers the sheet S, transported from the fixing device 15 by the transport device 21, to the output tray 18. On the output tray 18, the delivered sheet S is placed.

Referring now to FIG. 2A, FIG. 2B, and FIG. 3, the feeding device 13 will be described in further detail. FIG. 2A illustrates the action of the feeding device 13, taken when a sheet S having high rigidity is being transported. FIG. 2B illustrates the action of the feeding device 13, taken when a sheet S having low rigidity is being transported.

As shown in FIG. 2A and FIG. 2B, the feeding device 13 includes a sheet feeding device and a sheet transport device. The sheet feeding device delivers the sheet S from the sheet tray 12. The sheet feeding device may include a transport route 20. The sheet S is delivered along the transport route 20 of the sheet feeding device.

The sheet transport device transports the sheet S delivered from the sheet feeding device. The sheet transport device includes the transport route 20, the transport device 21 (see FIG. 1), a suction device 22, and a sheet sensor 23.

The sheet S is transported along the transport route 20 of the sheet transport device. In other words, the transport device 21 transports the sheet S along the transport route 20. The transport device 21 includes a transport belt 30 and a drive roller 31. The transport belt 30 is a belt-shaped member with holes perforated therethrough. The transport belt 30 transports the sheet S, by being made to rotate. The drive roller 31 is caused to rotate upon being driven by a drive device such as a motor, thereby causing the transport belt 30 to rotate. Here, the transport device 21 may be composed of a feed roller and a transport roller.

The suction device 22 is located on the inner side of the transport belt 30. The suction device 22 generates an intake flow, so that the sucked air passes through the holes of the transport belt 30. When the sheet S becomes engaged with the transport belt 30, the sheet S is adsorbed to the transport belt 30 by the suction air, thus to be transported by the transport belt 30. The suction device 22 can be exemplified by a fan.

The sheet sensor 23 is located upstream of the transport device 21, in the transport direction of the sheet S. The sheet sensor 23 outputs curvature information, indicating the curvature status of the sheet S being transported by the transport device 21. The sheet sensor 23 includes a bar-shaped member 50. The bar-shaped member 50 has an end portion pivotably supported by the sheet sensor 23, and is suspended downward so as to intersect the transport route 20.

The bar-shaped member 50 is biased by the sheet S, when the sheet S being transported along the transport route 20 enters into contact with the bar-shaped member 50. The sheet sensor 23 outputs the curvature information, proportionate to the magnitude of the biasing force exerted to the bar-shaped member 50 by the sheet S. For example, when the sheet S having high rigidity (high stiffness) is transported by the transport device 21, the sheet S is delivered to the transport belt 30 by being sucked by the suction device 22, while applying biasing force to the bar-shaped member 50 of the sheet sensor 23, as shown in FIG. 2A.

FIG. 3 indicates variations of an inclination angle of the bar-shaped member 50 with respect to the vertical direction, assumed when the sheet S is delivered to the transport belt 30. In FIG. 3, the horizontal axis represents the length of the sheet S in the sub scanning direction (transport direction), and the vertical axis represents the inclination angle of the bar-shaped member 50, with respect to the vertical direction.

As shown in FIG. 2A, when the sheet S has high rigidity, the trailing edge of the sheet S in the transport direction is barely curved downward, when the trailing edge of the sheet S reaches the position where the bar-shaped member 50 is located. Accordingly, the biasing force exerted to the bar-shaped member 50 barely varies, while the sheet S is passing the sheet sensor 23. Therefore, the variation of the inclination angle of the bar-shaped member 50 can be expressed by a line including sections A, D, and E in FIG. 3. In this case, the sheet sensor 23 outputs the curvature information indicating that the curvature amount is small. Alternatively, the sheet sensor 23 may output the curvature information indicating that the sheet S has high stiffness.

When the sheet S has medium rigidity, the trailing edge of the sheet S in the transport direction is slightly curved downward, when the trailing edge of the sheet S reaches the position where the bar-shaped member 50 is located, while the sheet S is transported by the transport device 21. Accordingly, the biasing force exerted to the bar-shaped member 50 is gradually reduced, while the sheet S is passing by the sheet sensor 23. Therefore, the variation of the inclination angle of the bar-shaped member 50 can be expressed by a line including sections B, D, and F in FIG. 3. In this case, the sheet sensor 23 outputs the curvature information indicating that the curvature amount is medium. Alternatively, the sheet sensor 23 may output the curvature information indicating that the sheet S has medium stiffness.

As shown in FIG. 2B, when the sheet S has low rigidity, the trailing edge of the sheet S in the transport direction is largely curved downward, when the trailing edge of the sheet S reaches the position where the bar-shaped member 50 is located, while the sheet S is transported by the transport device 21. Accordingly, the biasing force exerted to the bar-shaped member 50 is significantly reduced, while the sheet S is passing the sheet sensor 23. Therefore, the variation of the inclination angle of the bar-shaped member 50 can be expressed by a line including sections C, D, and G in FIG. 3. In this case, the sheet sensor 23 outputs the curvature information indicating that the curvature amount is large. Alternatively, the sheet sensor 23 may output the curvature information indicating that the sheet S has low stiffness.

The measuring device 4 measures the curvature amount of the sheet S, on the basis of the curvature information. The calculation device 5 calculates the rigidity of the sheet S, on the basis of the curvature amount thereof. The controller 6 controls the setting of at least one of the transport device 21 and the image forming device 14, on the basis of the rigidity of the sheet S.

Referring then to FIG. 4, a rigidity calculation process executed by the feeding device 13 will be described hereunder. FIG. 4 is a flowchart showing the operation performed by the feeding device 13 according to this embodiment. As shown in FIG. 4, the rigidity calculation process includes step S10 to step S16, which will be sequentially described hereunder.

At step S10, the transport device 21 transports the sheet S. After step S10, the operation proceeds to step S12. At step S12, the sheet sensor 23 outputs the curvature information indicating the curvature status of the sheet S. After step S12, the operation proceeds to step S14.

At step S14, the measuring device 4 measures the curvature amount of the sheet S, on the basis of the curvature information. After step S14, the operation proceeds to step S16. At step S16, the calculation device 5 calculates the rigidity of the sheet S, on the basis of the curvature amount. After step S16 is completed, the rigidity calculation process is finished.

Now, the existing image forming apparatuses are configured to measure the slack of the recording sheet, produced when the recording sheet is abutted against a stopper plate, to forcibly stop the movement of the recording sheet that is not so stiff with the stopper plate. Accordingly, there may be cases where the recording sheet is damaged.

According to this embodiment, in contrast, the rigidity of the sheet S can be properly measured, without the risk of damaging the sheet S. In addition, the setting of at least one of the transport device 21 and the image forming device 14 can be controlled, on the basis of the rigidity of the sheet S. Further, since the transport belt 30 serves to stably transport the sheet S, the sheet sensor 23 can accurately measure the curvature amount of the sheet S. Furthermore, the stiffness of the sheet S can be accurately measured, on the basis of the biasing force exerted to the bar-shaped member 50.

Figure 5A:
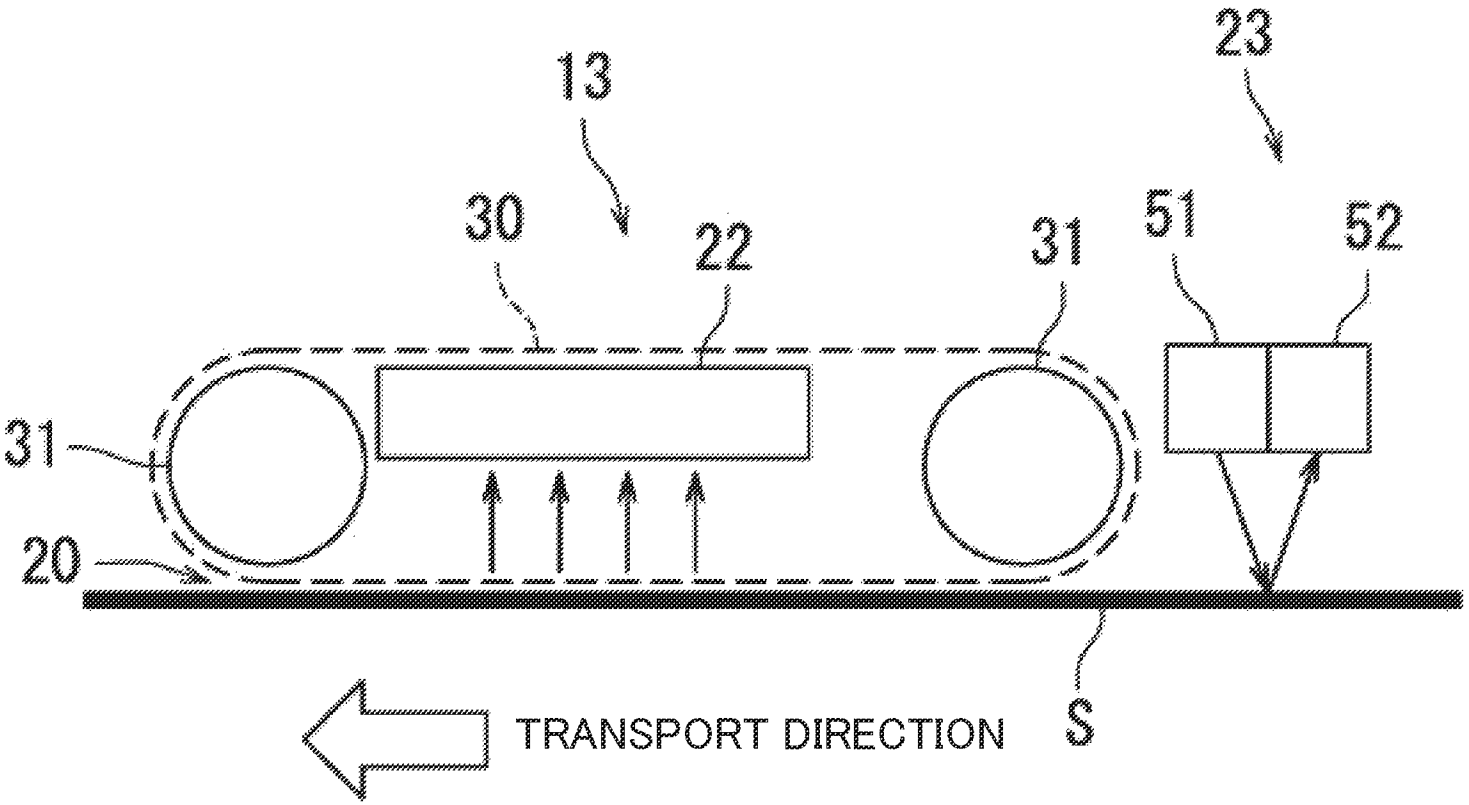
FIG. 5A and FIG. 5B are schematic drawings each showing the feeding device according to a first variation.
Figure 5B:
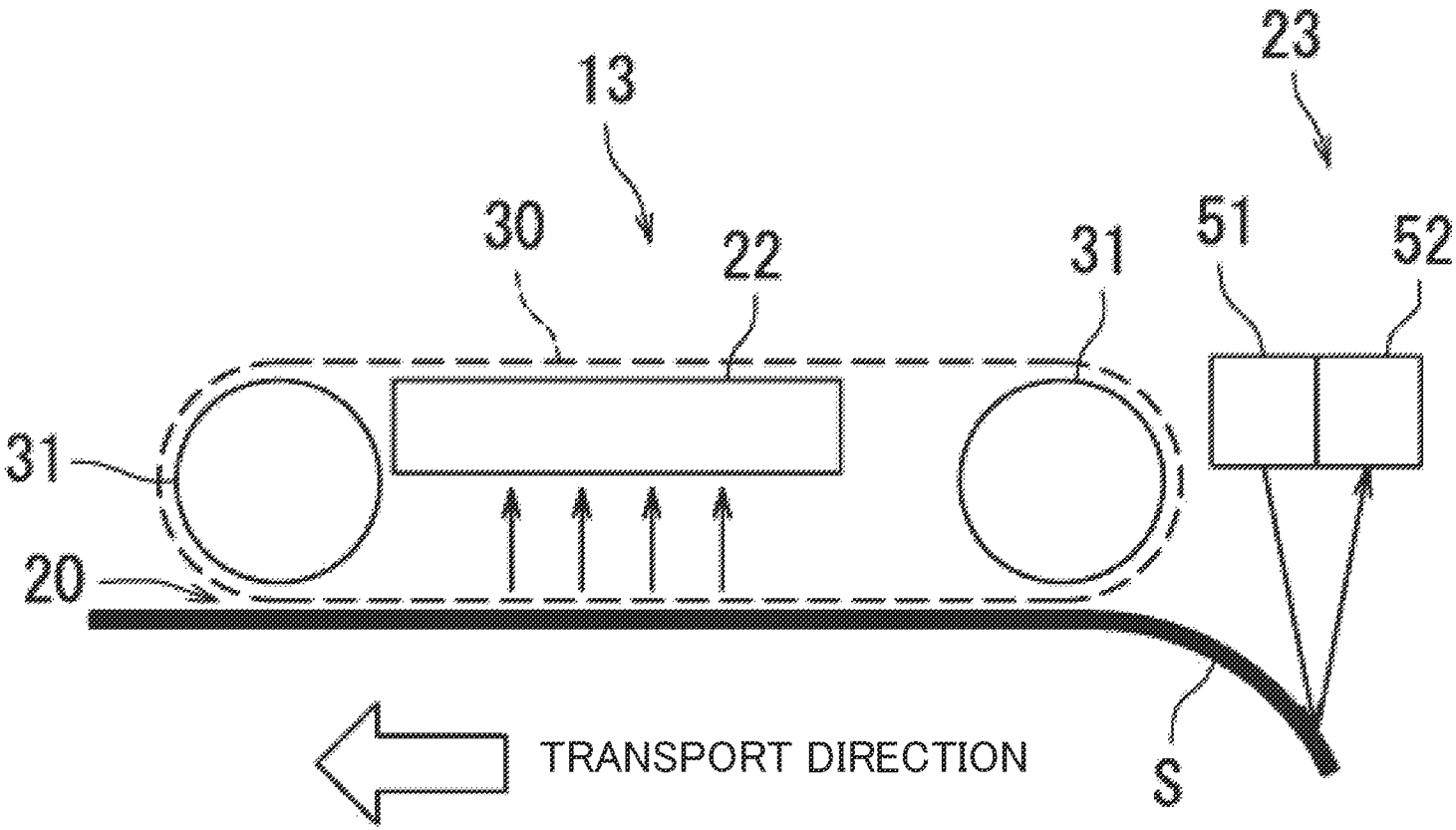
Figure 6:
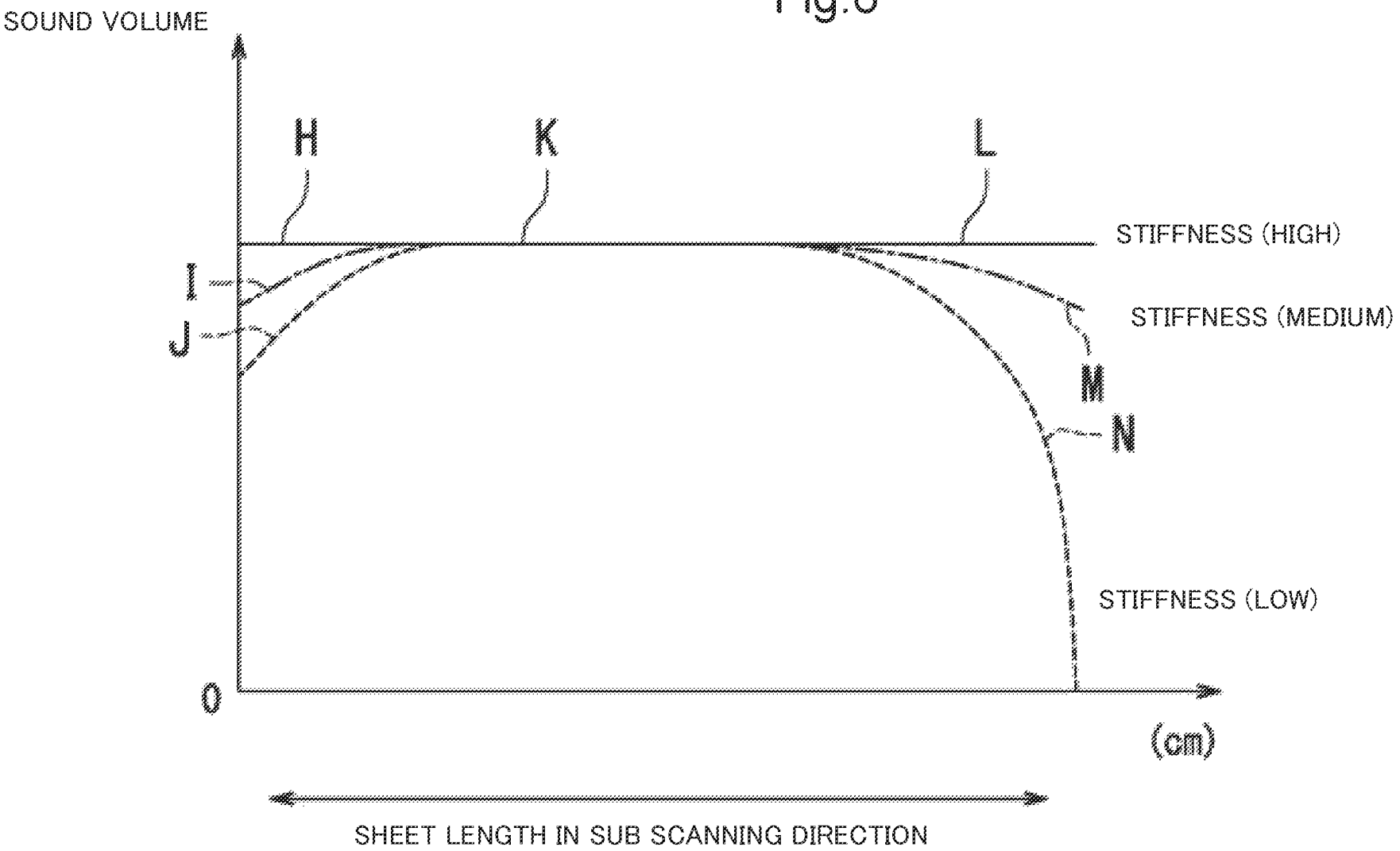
FIG. 6 is a graph for explaining curvature information outputted by a sheet sensor according to the first variation.

Referring to FIG. 5A, FIG. 5B, and FIG. 6, the feeding device 13 according to a first variation of the foregoing embodiment will be described hereunder. FIG. 5A and FIG. 5B are schematic drawings each showing the feeding device 1 according to the first variation. FIG. 6 is a graph for explaining the curvature information outputted by the sheet sensor 23 according to the first variation.

As shown in FIG. 5A, the sheet sensor 23 according to the first variation includes an ultrasonic transmitter 51 and an ultrasonic receiver 52. The ultrasonic transmitter 51 emits an ultrasonic wave toward the sheet S being transported along the transport route 20. The ultrasonic receiver 52 receives the ultrasonic wave reflected by the sheet S. The sheet sensor 23 outputs the curvature information, on the basis of the sound volume of the reflected wave received by the ultrasonic receiver 52.

To be more detailed, as shown in FIG. 5A and FIG. 5B, when the sheet S is transported by the transport device 21, the ultrasonic transmitter 51 emits the ultrasonic wave to the sheet S. The ultrasonic wave is reflected by the sheet S, and proceeds toward the ultrasonic receiver 52, so that the ultrasonic receiver 52 receives the reflected wave.

In FIG. 6, the horizontal axis represents the length of the sheet S in the sub scanning direction (transport direction), and the vertical axis represents the sound volume of the reflected wave.

As shown in FIG. 5A, when the sheet S has high rigidity, the trailing edge of the sheet S in the transport direction is barely curved downward, when the trailing edge of the sheet S reaches the position where the sheet sensor 23 is located. Accordingly, the ultrasonic receiver 52 receives the reflected wave of a large sound volume, while the sheet S is passing by the sheet sensor 23. Therefore, the variation of the sound volume of the reflected wave can be expressed by a line including sections H, K, and L in FIG. 6. In this case, the sheet sensor 23 outputs the curvature information indicating that the curvature amount is small. Alternatively, the sheet sensor 23 may output the curvature information indicating that the sheet S has high stiffness.

When the sheet S has medium rigidity, the trailing edge of the sheet S in the transport direction is slightly curved downward, when the trailing edge of the sheet S reaches the position where the sheet sensor 23 is located, while the sheet S is transported by the transport device 21. Accordingly, the sound volume of the reflected wave received by the ultrasonic receiver 52 is gradually reduced, while the sheet S is passing by the sheet sensor 23. Therefore, the variation of the inclination angle of the bar-shaped member 50 can be expressed by a line including sections I, K, and M in FIG. 6. In this case, the sheet sensor 23 outputs the curvature information indicating that the curvature amount is medium. Alternatively, the sheet sensor 23 may output the curvature information indicating that the sheet S has medium stiffness.

As shown in FIG. 5B, when the sheet S has low rigidity, the trailing edge of the sheet S in the transport direction is largely curved downward, when the trailing edge of the sheet S reaches the position where the sheet sensor 23 is located. Accordingly, the sound volume of the reflected wave received by the ultrasonic receiver 52 is significantly reduced, while the sheet S is passing by the sheet sensor 23. Therefore, the variation of the sound volume of the reflected wave can be expressed by a line including sections J, K, and N in FIG. 6. In this case, the sheet sensor 23 outputs the curvature information indicating that the curvature amount is large. Alternatively, the sheet sensor 23 may output the curvature information indicating that the sheet S has low stiffness.

According to the first variation, the sheet sensor 23 includes the ultrasonic transmitter 51 and the ultrasonic receiver 52. Therefore, the rigidity of the sheet S can be properly measured, on the basis of the sound volume of the ultrasonic wave, reflected by the sheet S and received by the ultrasonic receiver 52.

Figure 7A:
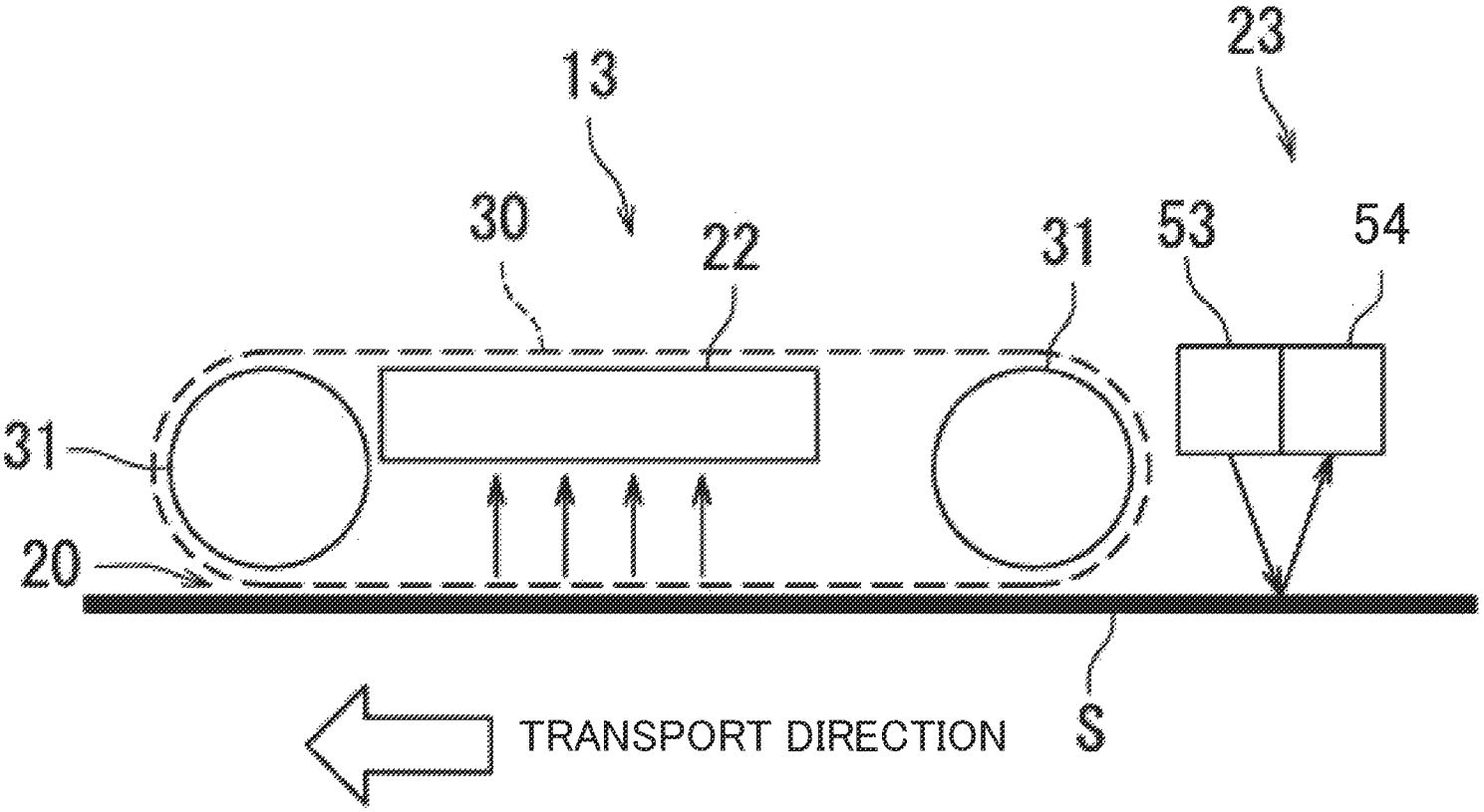
FIG. 7A and FIG. 7B are schematic drawings each showing the feeding device according to a second variation.
Figure 7B:
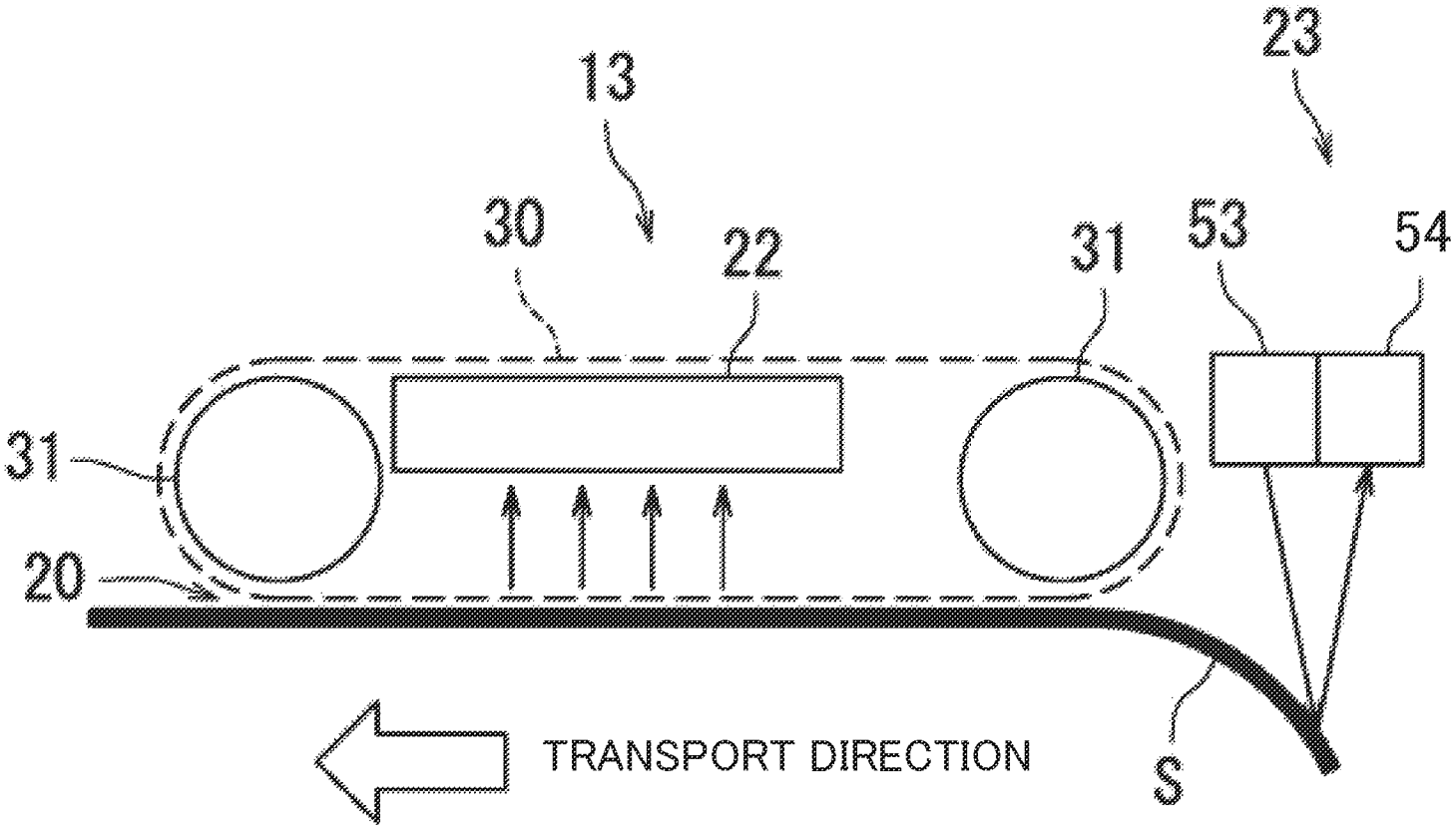
Figure 8:
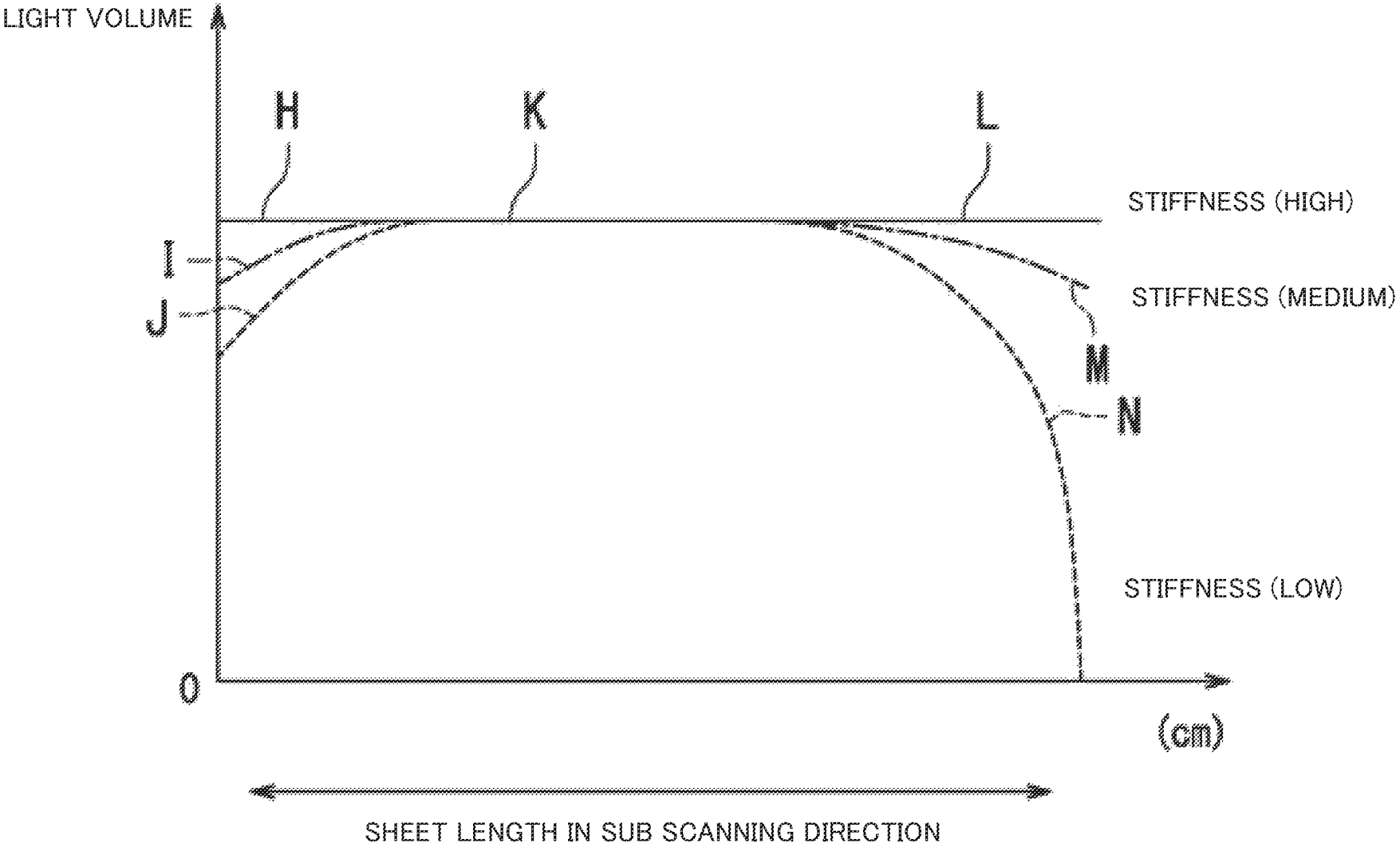
FIG. 8 is a graph for explaining curvature information outputted by a sheet sensor according to the second variation.

Referring then to FIG. 7A, FIG. 7B, and FIG. 8, the feeding device 13 according to a second variation of the foregoing embodiment will be described hereunder. FIG. 7A and FIG. 7B are schematic drawings each showing the feeding device 1 according to the second variation. FIG. 8 is a graph for explaining the curvature information outputted by the sheet sensor 23 according to the second variation.

As shown in FIG. 7A, the sheet sensor 23 according to the second variation includes a light emitter 53 and a photodetector 54. The light emitter 53 emits light toward the sheet S being transported along the transport route 20. The photodetector 54 receives the light reflected by the sheet S. The sheet sensor 23 outputs the curvature information, on the basis of the light volume of the reflected wave received by the photodetector 54.

To be more detailed, as shown in FIG. 7A and FIG. 7B, when the sheet S is transported by the transport device 21, the light emitter 53 emits the light to the sheet S. The light is reflected by the sheet S, and proceeds toward the photodetector 54, so that the photodetector 54 receives the reflected wave.

In FIG. 8, the horizontal axis represents the length of the sheet S in the sub scanning direction (transport direction), and the vertical axis represents the light volume of the reflected light.

As shown in FIG. 7A, when the sheet S has high rigidity, the trailing edge of the sheet S in the transport direction is barely curved downward, when the trailing edge of the sheet S reaches the position where the sheet sensor 23 is located. Accordingly, the photodetector 54 receives the reflected light of a large light volume, while the sheet S is passing by the sheet sensor 23. Therefore, the variation of the light volume of the reflected light can be expressed by a line including sections H, K, and L in FIG. 8. In this case, the sheet sensor 23 outputs the curvature information indicating that the curvature amount is small. Alternatively, the sheet sensor 23 may output the curvature information indicating that the sheet S has high stiffness.

When the sheet S has medium rigidity, the trailing edge of the sheet S in the transport direction is slightly curved downward, when the trailing edge of the sheet S reaches the position where the sheet sensor 23 is located, while the sheet S is transported by the transport device 21. Accordingly, the light volume of the reflected light received by the photodetector 54 is gradually reduced, while the sheet S is passing by the sheet sensor 23. Therefore, the variation of the light volume of the reflected light can be expressed by a line including sections I, K, and M in FIG. 8. In this case, the sheet sensor 23 outputs the curvature information indicating that the curvature amount is medium. Alternatively, the sheet sensor 23 may output the curvature information indicating that the sheet S has medium stiffness.

As shown in FIG. 7B, when the sheet S has low rigidity, the trailing edge of the sheet S in the transport direction is largely curved downward, when the trailing edge of the sheet S reaches the position where the sheet sensor 23 is located. Accordingly, the light volume of the reflected light received by the photodetector 54 is significantly reduced, while the sheet S is passing by the sheet sensor 23. Therefore, the variation of the light volume of the reflected light can be expressed by a line including sections J, K, and N in FIG. 8. In this case, the sheet sensor 23 outputs the curvature information indicating that the curvature amount is large. Alternatively, the sheet sensor 23 may output the curvature information indicating that the sheet S has low stiffness.

According to the second variation, the sheet sensor 23 includes the light emitter 53 and the photodetector 54. Therefore, the rigidity of the sheet S can be properly measured, on the basis of the light volume of the light reflected by the sheet S and received by the photodetector 54.

The embodiment of the disclosure has been described thus far, with reference to the drawings. However, the disclosure is not limited to the foregoing embodiment, but may be implemented in various different manners, without departing from the scope of the disclosure. The drawings schematically illustrate the constituent elements for the sake of clarity, and the number of pieces of the illustrated constituent elements may be different from the actual number, depending on the availability of space on the drawing sheet. Further, the constituent elements referred to in the embodiment are merely exemplary and not specifically limited, and therefore may be modified in various manners, without substantially compromising the advantageous effects of the disclosure.

INDUSTRIAL APPLICABILITY

The disclosure is applicable to the technical field of the feeding device.

While the present disclosure has been described in detail with reference to the embodiments thereof, it would be apparent to those skilled in the art the various changes and modifications may be made therein within the scope defined by the appended claims.

What is claimed is:

1. A feeding device comprising:

a sheet tray on which a sheet is placed;

a transport device that transports the sheet placed on the sheet tray;

a sheet sensor that outputs curvature information indicating a curvature status of the sheet being transported by the transport device, the sheet sensor being located upstream of the transport device in a sheet transport direction; and a control device including a processor, and configured to act, when the processor executes a control program, as:

a measuring device that measures a curvature amount of the sheet, on a basis of the curvature information; and a calculation device that calculates rigidity of the sheet, on a basis of the curvature amount, wherein the sheet sensor includes an ultrasonic transmitter that emits ultrasonic wave toward the sheet, and an ultrasonic receiver that receives the ultrasonic wave reflected by the sheet, and the sheet sensor outputs the curvature information based on sound volume of the reflected wave.

2. The feeding device according to claim 1, further comprising an image forming device that forms an image on the sheet, wherein the control device further acts as a controller that controls setting of at least one of the transport device and the image forming device, on a basis of the rigidity.

3. The feeding device according to claim 1, wherein the transport device includes a transport belt that transports the sheet, and a drive roller that drives the transport belt so as to rotate.

4. The feeding device according to claim 1, wherein the sheet sensor outputs the curvature information indicating an extent of the curvature amount of the sheet, or the curvature information indicating an extent of stiffness of the sheet.

* * * * *